US006102079A

United States Patent [19]

Croucher et al.

[11] Patent Number: 6,102,079

[45] Date of Patent: Aug. 15, 2000

[54] VISUAL DIAGNOSTIC SYSTEM FOR A JACQUARD MACHINE

[75] Inventors: Ewan Croucher; Robin Frank Hamilton Sillem, both of Jarrow, United Kingdom

[73] Assignees: Scapa Group PLC, Blackburn; Northern Electronic Technology Limited, Jarrow, both of United Kingdom

[21] Appl. No.: 09/319,919

[22] PCT Filed: Dec. 17, 1997

[86] PCT No.: PCT/GB97/03366

§ 371 Date: Jul. 23, 1999

§ 102(e) Date: Jul. 23, 1999

[87] PCT Pub. No.: WO98/27254

PCT Pub. Date: Jun. 25, 1998

[30] Foreign Application Priority Data

Dec. 19, 1996 [GB] United Kingdom ..... 9626432

[51] Int. Cl.[7] ..... D03D 51/46; D03C 3/24; D03C 17/06

[52] U.S. Cl. ..... 139/1 R; 139/370.1; 28/187; 242/534; 348/88; 250/559.46; 382/11

[58] Field of Search ..... 139/370.1, 1 R; 28/187; 242/534; 348/88; 250/559.46; 382/111

[56] References Cited

U.S. PATENT DOCUMENTS

| | | | |
|---|---|---|---|
| 4,019,036 | 4/1977 | Hiramatsu et al. | 235/151.1 |
| 4,416,310 | 11/1983 | Sage | 139/59 |
| 4,582,095 | 4/1986 | Kronholm | 139/1 R |
| 4,827,986 | 5/1989 | Tanaka | 139/337 |
| 5,251,673 | 10/1993 | Adachi et al. | 139/370.1 |

FOREIGN PATENT DOCUMENTS

| | | |
|---|---|---|
| 0 330 624 | 8/1989 | European Pat. Off. . |
| 0 461 078 | 12/1991 | European Pat. Off. . |
| 36 18 467 | 1/1987 | Germany . |
| 711955 | 7/1954 | United Kingdom . |
| 944891 | 12/1963 | United Kingdom . |
| 1005664 | 9/1965 | United Kingdom . |
| 1215045 | 12/1970 | United Kingdom . |
| 1554260 | 10/1979 | United Kingdom . |
| 2221475 | 2/1990 | United Kingdom . |
| 2312440 | 10/1997 | United Kingdom . |

*Primary Examiner*—Andy Falik
*Attorney, Agent, or Firm*—Jacobson, Price, Holman & Stern, PLLC

[57] ABSTRACT

A diagnostic system for a jacquard machine having a plurality of heald hooks (16) moveable between at least two discrete shed positions, the system including visual sensing means (30) for producing a visual image of hooks (16) located at one of said shed positions during each weaving cycle, and control means (49) for comparing said visual image with a predetermined shed pattern for each corresponding weaving cycle in order to determine whether or not all the appropriate hooks have been selected to define the required shed pattern.

6 Claims, 1 Drawing Sheet

VISUAL DIAGNOSTIC SYSTEM FOR A JACQUARD MACHINE

BACKGROUND OF THE INVENTION

1. Field of the Invention

The present invention relates to a diagnostic system for a jacquard machine, in particular, a jacquard machine for a weaving loom.

2. Description of the Related Art

Jacquard machines for weaving looms usually include a plurality of heald hooks arranged in rows extending in the weft direction, the rows being located side by side in the warp direction.

Each row of hooks is acted upon by a reciprocating knife such that selected hooks in the row are moved from one shed position to and held at another shed position during a pick in the weaving cycle. Depending upon the type of jacquard machine, the knife may move only selected hooks from said one shed position or may move all hooks from said one shed position such that selected hooks can be retained at said one shed position.

In order to ensure that fabric being woven has no faults caused by failure to select a chosen heald hook it is known to provide detection means which act to produce a signal should the chosen heald hook not be selected. Such detection means are usually in the form of mechanically operated electrical switches and these tend to be unreliable. In addition, in a Jacquard machine, there can be several thousand heald hooks and so the use of mechanical switches becomes increasingly more unsatisfactory and costly.

BRIEF SUMMARY OF THE INVENTION

According to one aspect of the present invention, there is provided a diagnostic system for a jacquard machine having a plurality of heald hooks movable between at least two discrete shed positions, the system including visual sensing means for producing a visual image of hooks located at one of said shed positions during each weaving cycle, and control means for comparing said visual image with a predetermined shed pattern for each corresponding weaving cycle in order to determine whether or not all the appropriate hooks have been selected to define the required shed pattern.

Preferably, the visual sensing means comprises at least one video camera located to one side of the jacquard machine so as to view the heald hooks at an inclined angle.

Preferably, datum means are provided to enable the control means to determine the location of each heald hook. The datum means may be in the form of a pattern located around the periphery of the rows of heald hooks to thereby enable the control means to create an orthogonal virtual grid of imaginary lines, the location of each hook being at the intersection of said imaginary lines.

The heald hooks may be adapted to make them more visibly distinct, for example, by being coated with a suitable paint.

According to another aspect of the present invention, there is provided a diagnostic method for a jacquard machine having a plurality of heald hooks movable between at least two shed positions, the method including the steps of creating a visual image of hooks located at one of said shed positions during each weaving cycle, and comparing said visual image with a predetermined shed pattern for each corresponding weaving cycle in order to determine whether or not all the appropriate hooks have been selected to define the required shed pattern.

Various aspects of the present invention are hereinafter described with reference to the accompanying drawings in which:

DETAILED DESCRIPTION OF THE INVENTION

Figure 1:
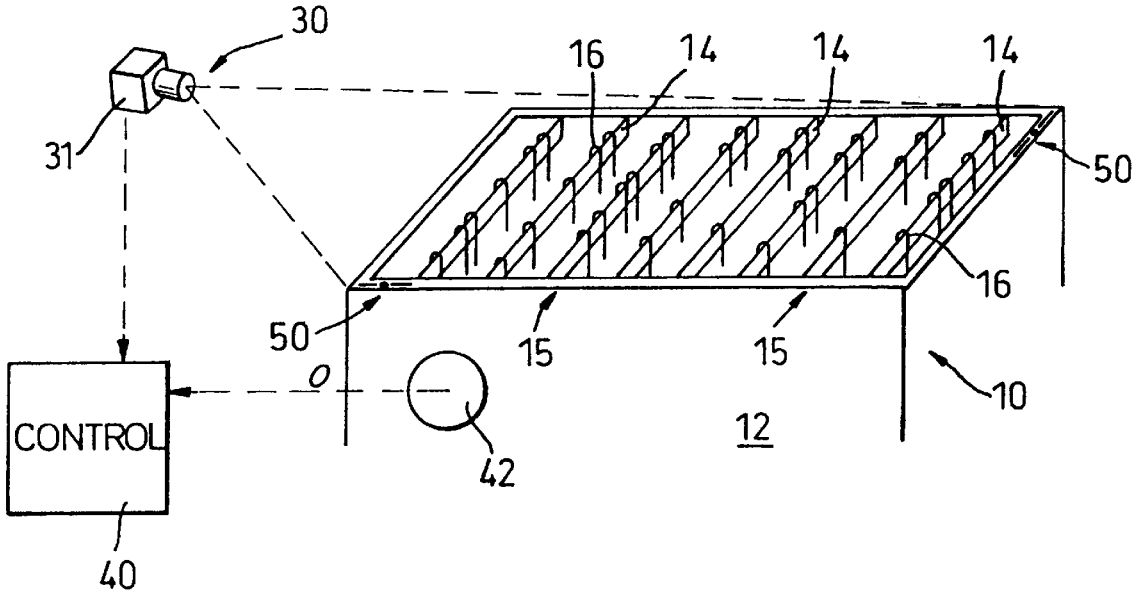
FIG. 1 is a schematic perspective view of the upper part of a Jacquard machine including a diagnostic system according to the present invention.
Figure 2:
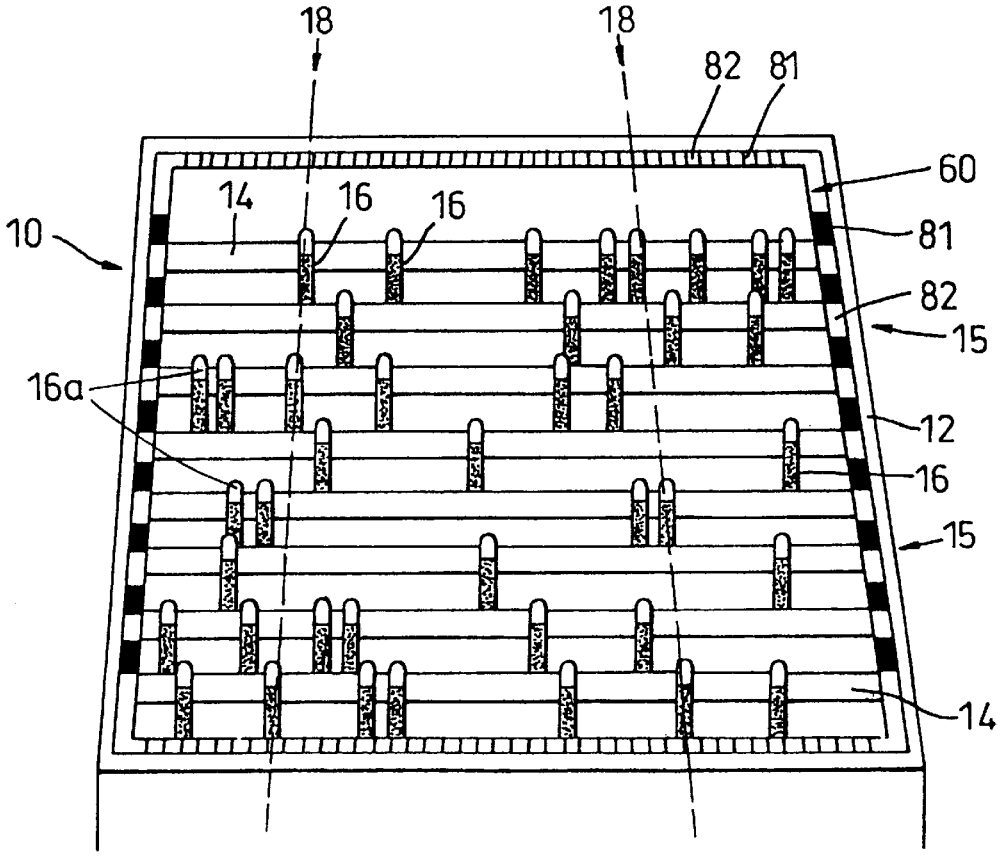
FIG. 2 is a schematic diagram showing the image viewed by the camera in FIG. 1.

A jacquard machine 10 is schematically shown in FIGS. 1 and 2 having a frame 12 in which a plurality of lifting knives 14 are mounted for reciprocal movement.

Each knife 14 co-operates with a row 15 of heald hooks 16, there being shown eight rows 15 of heald hooks and eight lifting knives. It will be appreciated that any number of knives 14 and corresponding rows 15 may be provided. Each row 15 contains the same number of heald hooks 16. The heald hooks 16 are regularly spaced along the corresponding knife and are aligned with heald hooks 16 located at the same position on neighbouring rows.

Accordingly, the heald hooks 16 are also arranged in rows 18 which are spaced side-by-side along the knives 14.

It will be appreciated therefore that the heald hooks 16 are arranged in an orthogonal grid pattern composed of rows 15 and rows 18, each heald hook 16 being located at the intersection of each row 15 and row 18.

In accordance with the present invention, there is provided a diagnostic system which includes a visual sensing means 30 and an electronic control 40.

The visual sensing means 30 is preferably in the form of a video camera 31 which is mounted above and to one side of the top of the jacquard machine 10 so as to view hooks 16 as they rise to their upper shed position. The image viewed by the camera is schematically shown in FIG. 2.

The electronic control 40 preferably comprise a computer which receives the video image from the camera, preferably via a digitizer interface.

The computer is arranged to receive an operating signal O during each weaving cycle. The operating signal O may be generated by, for example, a sensor on the drive shaft 42 of the jacquard in the case of a jacquard having mechanically operated pattern selection or may be generated from the electronic control of a jacquard having electronically controlled pattern selection.

On receipt of signal O, the computer is arranged to grab an image from the camera and use the image to identify the presence of hooks located at their upper shed position and then determine whether or not all selected hooks have been raised.

Preferably, the camera is a monochrome camera and preferably, the upper portion 16*a* of the hooks 16 have been adapted, for example, by painting to define a high contrast with their background. In this respect, preferably the upper portions 16*a* and painted white so that the upper portions 16*a* when viewed by the camera appear light compared to the background.

Accordingly, the presence of a hook 16 at its upper shed position is identified in the grabbed image by the computer software locating the areas of bright pixels.

Having identified the presence of a hook, it is necessary for the computer to determine its location in the array of hooks so as to enable the computer to determine whether or not that hook should be at its upper shed position.

It is appreciated that the computer could be programmed with a look-up map identifying the locations of each hook. However, this would require the camera to be accurately positioned and for it to remain in that position during its working life. Accordingly, it is preferred to provide a system whereby the computer can determine the grid locations of the heald hooks using the image produced by the camera.

A first method is to locate targets at predetermined positions on the jacquard frame 12. For example, as seen in FIG. 1 a pair of targets 50 may be provided at diagonally opposite corners of the jacquard frame 12. The shape and contrast of the target 50 is chosen so as to be easily recognised by the software and provides a pair of fixed reference points in the image produced by the camera.

Prior to a weaving operation, a set-up routine is performed.

This initially involves the computer locating the targets 50 and storing in memory their co-ordinates. The jacquard machine is then run with a predetermined weave pattern, for example, a plain weave, and the software reconciles the pattern of the lifted hooks 16 in the image with the predetermined pattern sequence and provides and stores in memory co-ordinates in the image for each hook grid location.

After this set-up procedure, the computer is able to accurately monitor lifting of each hook as long as the camera position does not change. Accordingly, the computer preferably continually monitors the co-ordinates of the viewed targets 50 and compares them with the co-ordinates stored during set-up. If the comparison shows that the camera position has changed, weaving is stopped and a new set-up routine is performed.

A second method of determining the grid location of each hook 16 is illustrated in FIG. 2.

In FIG. 2, a rectangular target 60 is provided on the top of the machine frame 12 and is arranged to identify the position of rows 15 and rows 18. The target 60, for example as shown in FIG. 2, consists of dark areas 81 contrasting with light areas 82. The dark areas 81 may, for example, be aligned with each row 15 or 18.

The software is arranged to scan the image and using the target 60 create a virtual grid of imaginary orthogonal lines. The software determines the cross-over points of the orthogonal lines and thereby determines the grid location of each heald hook 16. Scanning of the image to create the virtual grid occurs during each weaving cycle. Accordingly, movement of the camera does not affect determination of the grid location of each hook.

It will be appreciated that it is not necessary to provide a visual identification for every row 15 or 18 since the dimensions of the hook array are known and so some rows positions can be interpolated knowing the positions of the other rows.

Also, since the geometry of the target panel 60 are known, the scanned information used to determine the virtual grid will automatically compensate for perspective errors in the image caused by some hooks being closer to the camera than others.

What is claimed is:

1. A diagnostic system for a jacquard machine having a plurality of heald hooks moveable between at least two discrete shed positions, the system including visual sensing means for producing a visual image of hooks of the plurality of heald hooks which are located at one of said shed positions during each weaving cycle, and control means for comparing said visual image with a predetermined shed pattern for each corresponding weaving cycle in order to determine whether or not all the appropriate hooks have been selected to define the required shed pattern.

2. The system according to claim 1 wherein the visual sensing means comprises at least one video camera located to one side of the jacquard machine so as to view the heald hooks at an inclined angle.

3. The system according to claim 1 wherein datum means are provided to enable the control means to determine the location of each heald hook.

4. The system according to claim 1 wherein datum means are provided to enable the control means to determine the location of each heald hook, the datum means being in the form of a pattern located around the periphery of the rows of heald hooks.

5. The system according to claim 1 wherein the hooks are adapted to make them visibly distinct.

6. A diagnostic method for a jacquard machine having a plurality of heald hooks moveable between at least two shed positions, the method including the steps of creating a visual image of hooks of the plurality of heald hooks which are located at one of said shed positions during each weaving cycle, and comparing said visual image with a predetermined shed pattern for each corresponding weaving cycle in order to determine whether or not all the appropriate hooks have been selected to define the required shed pattern.

* * * * *